US006234086B1

(12) United States Patent
Mason

(10) Patent No.: US 6,234,086 B1
(45) **Date of Patent: *May 22, 2001**

(54) PROTECTOR FOR AN ARRAY OF PALLETS

(75) Inventor: Allen Mason, Palm Beach, FL (US)

(73) Assignee: Food Machinery Equipment Corporation, Palm Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/519,300

(22) Filed: Mar. 6, 2000

(51) Int. Cl.[7] ..... B65D 19/00
(52) U.S. Cl. ..... 108/51.11; 108/55.1
(58) Field of Search ..... 108/51.11, 56.1, 108/56.3, 27, 57.12, 55.1, 55.3

(56) References Cited

U.S. PATENT DOCUMENTS

| | | | |
|---|---|---|---|
| 1,918,634 | 7/1933 | Cordes | 108/27 X |
| 3,181,176 | 5/1965 | Nagy et al. | 108/27 X |
| 4,292,899 | 10/1981 | Steffen . | |
| 4,635,562 | 1/1987 | Kreeger | 108/55.1 |
| 4,715,294 | 12/1987 | Depew . | |
| 5,076,175 | 12/1991 | Whatley, II . | |
| 5,180,134 | 1/1993 | Mallak | 108/55.1 X |
| 5,496,609 | 3/1996 | Michelstein | 108/27 X |
| 5,609,111 | 3/1997 | Hasegawa et al. | 108/55.1 |
| 5,673,629 | 10/1997 | Ginnow . | |

FOREIGN PATENT DOCUMENTS

| | | | |
|---|---|---|---|
| 3618357 | 10/1987 | (DE) | 108/27 |
| 3143612 | 6/1991 | (JP) | 108/27 |

*Primary Examiner*—Jose V. Chen
(74) *Attorney, Agent, or Firm*—Caesar, Rivise, Bernstein, Cohen & Pokotilow, Ltd.

(57) ABSTRACT

A pallet protector assembly for use with an array of A rows by B columns of pallets, e.g., conventional pallets such as wooden pallets, having a plurality of stringers disposed generally parallel to one another between upper and lower decks formed of plural spaced-apart deck-boards. Each pallet has a pair of sides and a pair of ends. The pallet protector assembly comprises plural elongated bar-like, hollow plastic, guard members, each of which has an opposed pair of end portions. Each end portion of each guard member includes a respective connector. One of the connectors is a cylindrical pin and the other a cylindrical hole. The pin of one of the two guard members is arranged to be matingly releasably received within a hole in another of the other guard members, and so forth and so on, to releasably secure all the guard members to one another to form a self-supporting frame encircling the periphery of the array of pallets. The connectors forming the guard members are resistant to accidental disconnection from each other so that the protector assembly when in place is resistant to accidental disconnection thereby holding the array together. However, any guard member can be readily purposely removed from the others to provide access to any portion of any pallet, e.g., access to an end portion of one pallet, to enable that pallet to be lifted by the tines of a conventional fork-lift machine.

22 Claims, 5 Drawing Sheets

PROTECTOR FOR AN ARRAY OF PALLETS

BACKGROUND OF THE INVENTION

This invention relates generally to pallets for supporting materials, and more particularly to a protector or guard device which is arranged to be readily disposed about the periphery of a plurality of pallets to protect the pallets and persons coming into contact with the pallets.

In U.S. Pat. No. 4,715,294 (Depew) there is disclosed a pallet construction making use of protective members fabricated out of metal, plastic or other impact resistant material for engaging two opposed end portions of the pallet to protect against damage. The protective members are in the form of upper and lower elongated bars and associated cap portions. The protective members are arranged to be secured in place to the pallet, via nails or screws, with the bars extending flush with the top and bottom surfaces of the upper and lower deck-boards, and with the cap portions embracing the end portions ofthe stringers or other deck-board supporting components. The cap portions are secured to the embraced portions beneath the deck-boards. Flanges may be provided on the cap portions at the end of the protective members for direct securement to the upper surface of the deck-boards and to the under surface of the underlying portion of the pallet. With pallets of block type construction, side protective members may be included to be nailed, screwed or otherwise secured to sides of the pallet, whereupon the periphery of the pallet is protected.

Other pallet protectors have been disclosed in the patent literature. For example, U.S. Pat. No. 4,292,899 (Steffen) discloses a protective element for a pallet in the form of a plate, preferably formed of sheet metal for a fixation to deleting stringer of the pallet. The plate-like element is preferably nailed to the pallet.

U.S. Pat. No. 5,076,175 (Whatley, II) also discloses a protective plate for use with a pallet. The plates may include perforations or holes to receive fasteners such as nails for fixing the plate to the pallet. The plates are disclosed as being fabricated from sheet metal.

U.S. Pat. No. 5,673,629 (Ginnow) discloses an end cap construction for protecting the ends of the stringers of a pallet. Each of the end cap construction units is a generally U-shaped member having plural apertures therein.

While the aforementioned prior art devices may be generally suitable for their intended purposes of protecting the pallet from damage by a fork-lift apparatus used to lift and transport the pallet, they still leave much to be desired from one or more of the following standpoints, e.g., inability to cover the entire periphery of the pallet, complexity of construction, inability to be readily removed from the pallet.

In my copending U.S. patent application Ser. No. 09/411,762 filed on Oct. 4, 1999, entitled Pallet Protector Assembly, whose disclosure is incorporated by reference herein there is disclosed a pallet protector assembly which overcomes many of the disadvantages of the prior art. That pallet protector assembly is arranged to be used on a conventional pallet, e.g., a wooden pallet having a plurality of stringers disposed generally parallel to one another between upper and lower decks formed of plural spaced-apart deck-boards. The pallet has a pair of sides and a pair of ends. The pallet protector assembly comprising plural, e.g., four, elongated bar-like, hollow plastic, guard members, each which has an opposed pair of end portions. Each end portion of each guard member includes a respective connector. Both of the connectors of two of the guard member are bulbous key-like projections. Both of the connectors of the other two of the guard members are mating key-slot shaped recess. The bulbous key-like projections of the two guard members are arranged to be releasably received within respective recesses of the other two guard member to releasably secure the guard members to one another to form a self-supporting frame encircling the periphery of the pallet. The connectors forming the guard members are resistant to accidental disconnection from each other so that the protector assembly when in place is resistant to accidental disconnection. However, any guard member can be readily purposely removed from the others to provide access to any portion of the pallet, e.g., access to an end portion to enable the pallet to be lifted by the tines of a conventional fork-lift machine.

For some applications plural pallets may be disposed in an array adjacent one another. For example, two pallets may be disposed end-to-end or side-by-side, four pallets may be disposed in 2 by 2 array, six pallets may be disposed end-to-end or side-to-side, etc. While my aforementioned pallet protector assembly is suitable for protecting a single pallet, it still leaves something to be desired from the standpoint of protecting the periphery of an array of pallets.

OBJECTS OF THE INVENTION

Accordingly, it is a general object of this invention to provide a pallet protector assembly that overcomes the limitations of the prior art.

It is another object of this invention to provide a pallet protector assembly that can be readily assembled about the periphery of plural pallets.

It is another object of this invention to provide a pallet protector that can be readily disassembled from an array of plural pallets.

It is another object of this invention to provide a self-supporting pallet protector assembly for an array of pallets.

It is a further object of this invention to provide a pallet protector assembly which when assembled covers the entire periphery of the array of pallets to protect them from damage, while also protecting personnel from injury (e.g., splinters from any wooden pallet in the array).

It is a further object of this invention to provide a pallet protector assembly for covering the entire periphery of an array of pallets, but which may be removed in sections, to provide ready access to any side of any pallet.

It is a further object of this invention to provide a pallet protector assembly for plural pallets and that is formed of plural light weight, impact resistant guard members which are arranged to be readily interconnected with one another about the array.

It is still a further object of this invention to provide a pallet protector assembly of modular construction for use with an array of pallets.

It is still a further object of this invention to provide a pallet protector assembly of simple construction for use with an array of pallets.

It is yet a further object of this invention to provide a low-cost pallet protector assembly for use with an array of pallets.

It is yet a further object of this invention to provide an easy-to-manufacture pallet protector assembly for an array of pallets.

It is yet a further object of this invention to provide a pallet protector assembly for an array of pallets and which may be color coded to provide the user information.

SUMMARY OF THE INVENTION

These and other objects of the instant invention are achieved by providing a pallet protector assembly for use with at least two conventional pallets, e.g., wooden pallets each having a plurality of stringers disposed generally parallel to one another underneath an upper deck. The upper deck is formed of plural spaced-apart deck-boards. Each pallet is of a generally rectangular or square shape and has a pair of sides and a pair of ends.

The pallet protector assembly comprises plural elongated bar-like guard members. Each of the guard members has a pair of end portions. Each of the end portions includes a respective connector, e.g., one of the connectors of each of the guard members comprises a recess located in one end of the guard member, and the other of the connectors comprises a mating projection in the other end of the guard member. The connectors of respective ones of the elongated bar-like guard members are releasably securable to each other to form a self-supporting frame for encircling the periphery of the pallet and when so connected are resistant to accidental disconnection from one another.

In accordance with one preferred embodiment of the invention each of the guard members is formed of a light-weight, impact resistant material, such as polyethylene, polyolefin cellulose composite, or other plastics.

DETAILED DESCRIPTION OF THE PREFERRED EMBODIMENT

Figure 1:
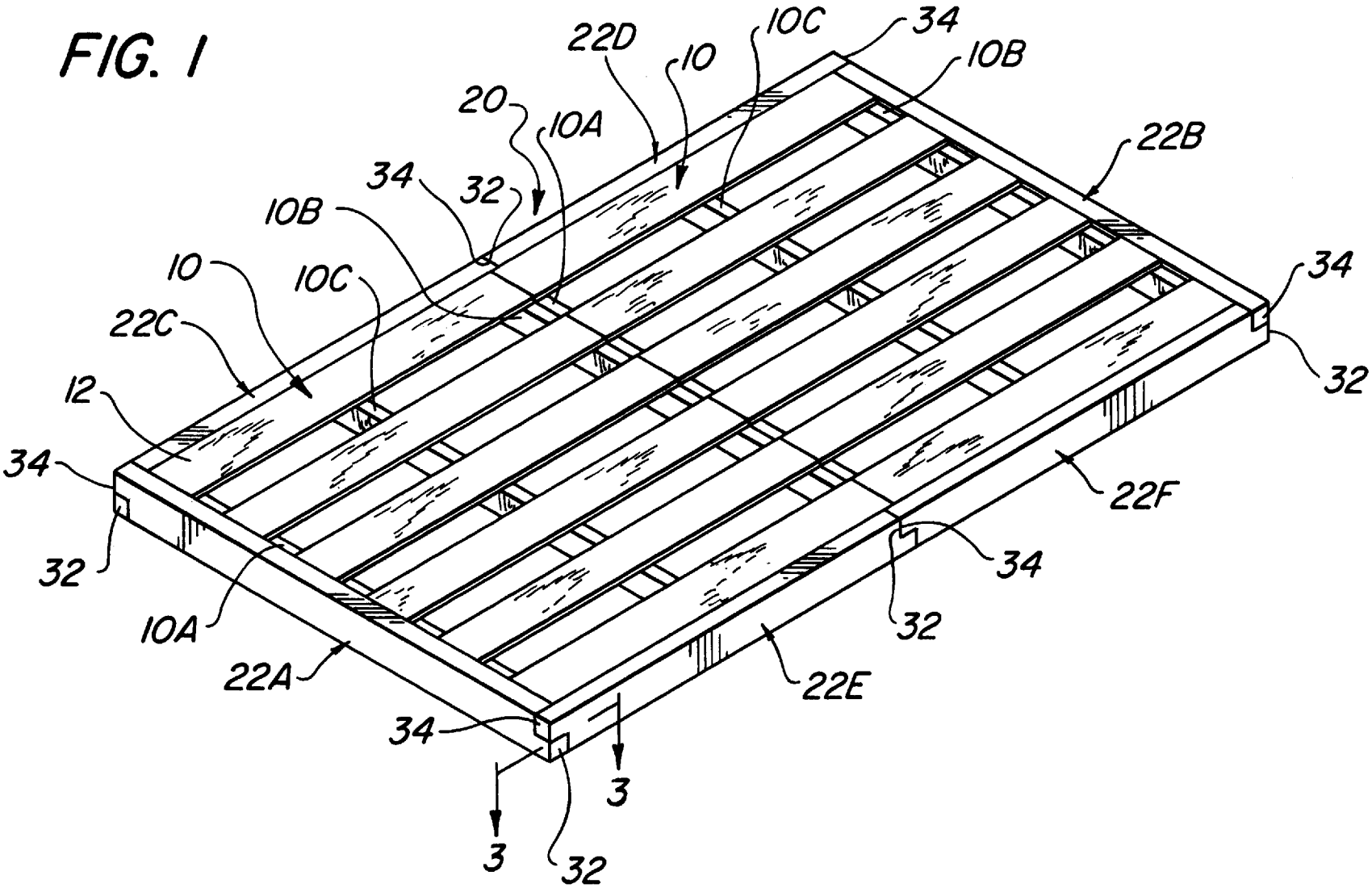
FIG. 1 is an isometric view of a pallet protector assembly constructed in accordance with the subject invention being shown in place about the periphery of two conventional pallets, e.g., each a single faced, flush-stringer wooden pallet, to form an "end cap display"

Referring to FIG. 1 there is shown at 20 a pallet protector or guard assembly constructed in accordance with this invention and shown in its assembled state mounted about the periphery of at least two conventional pallets 10. The assembly 20 basically comprises a modular set of components, i.e., plural guard members (to be described later), which are arranged to be releasably secured to one another to form a peripheral wall which surrounds the pallet array. This protective wall serves various purposes. For example, when in place it protects the pallets from injury which could otherwise result from any of the pallets of the array being impacted by some piece of machinery, e.g., a fork-lift truck, or other object. Moreover, the pallet protector assembly 20 also serves to protect personnel and others in the vicinity ofthe pallets from being injured by contact with the pallet, e.g., being injured by a splinter from any pallet.

Before discussing the pallet protector assembly 20 a brief description of each of the pallets of the array is in order. Each pallet 10 may be of a single-face, flush-type stringer design, or a reversible or double-faced, flush-type stringer design. As is known, a single faced pallet includes plural, e.g., two, parallel outer stringers 10A and 10B and a central stringer 10C. The three stringers are elongated bar-like members disposed parallel and equidistantly to one another. The outer stringers define the two opposed sides of the pallet, with their respective ends defining the two opposed ends ofthe pallet. In the double-faced, reversible pallet the stringers 10A, 10B and 10C are disposed between upper and lower decks 12 and 14, respectively (see FIG. 2). Each deck is made up of a plurality of spaced-apart deck-boards 16. In the single-faced pallet the stringers 10A, 10B and 10C are disposed under an upper deck 12. The deck-boards are fixedly secured to stringers by nails, screws, or other suitable fasteners. When so connected, the upper and lower decks and the stringers 10A, 10B, and 10C cooperate to define the a pair of side-by-side, lengthwise extending, open-ended passages 18 (FIG. 2) for receiving the tines of the fork of a fork-lift truck for facilitating load handling. In the single-faced pallet, the passageways have no bottom wall, since there is no lower deck.

Figure 2:
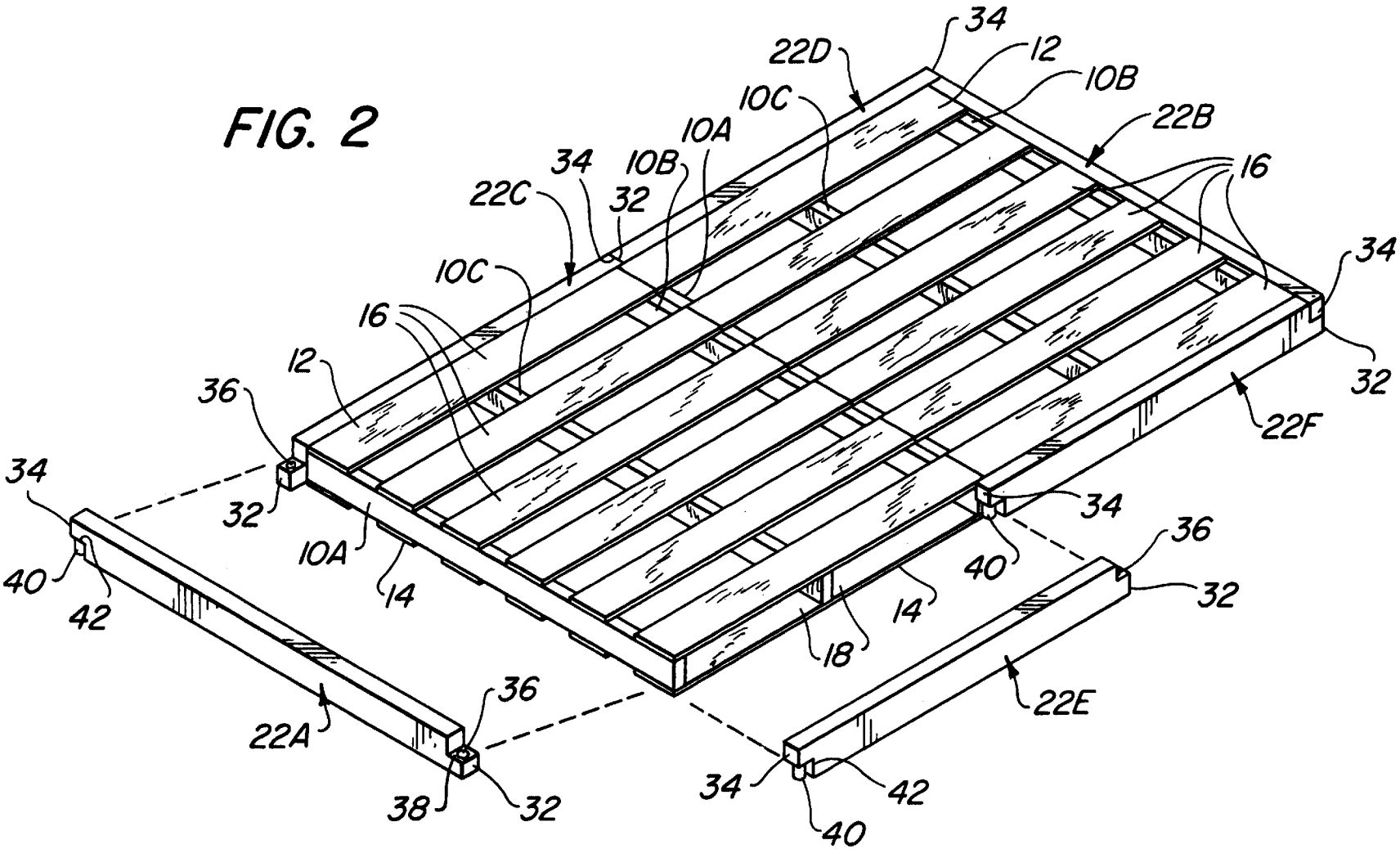
FIG. 2 is an exploded isometric view of the pallet protector assembly shown in FIG. 1.
Figure 3:
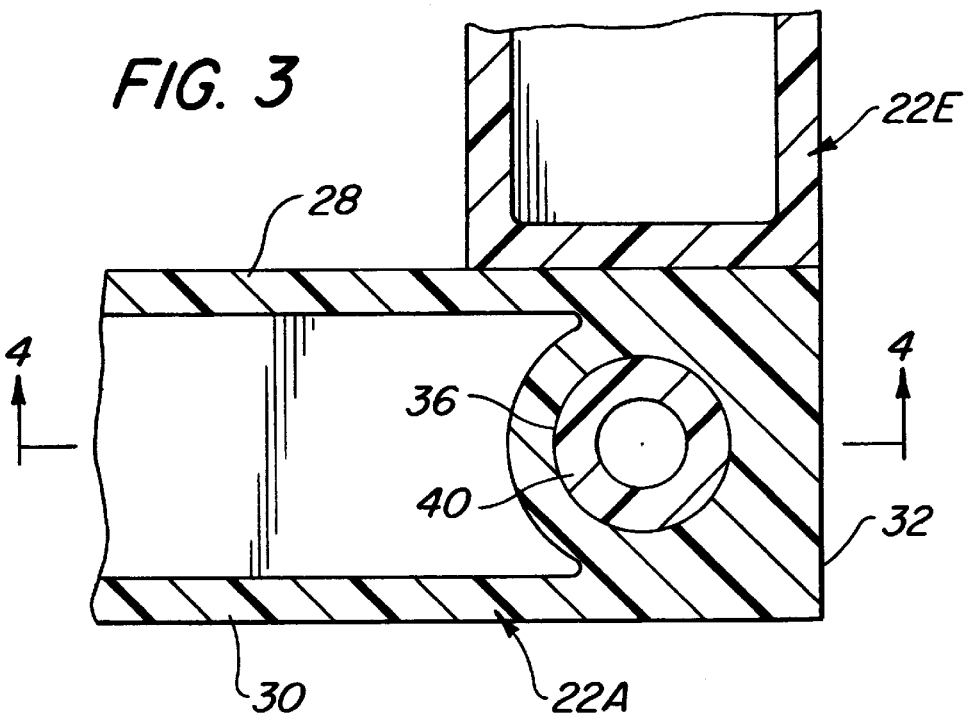
FIG. 3 is an enlarged sectional view taken along line 3—3 of FIG. 1.
Figure 4:
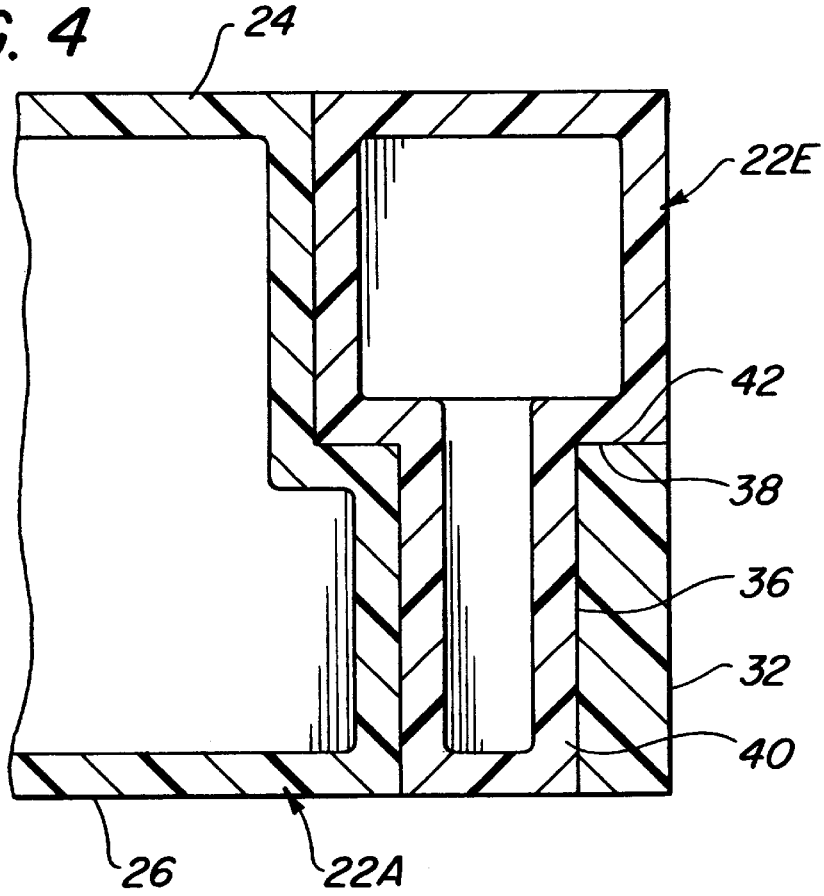
FIG. 4 is a sectional view taken along line 4—4 of FIG. 3.

The pallet 10 is typically formed of wood, but may be formed of any durable, wear-resistant, load-supporting material. Examples of such other materials are plastics, metals, etc. As will be appreciated by those skilled in the art, conventional pallets 10 like those described above, while relatively low in cost and easy to fabricate, suffer from various disadvantage. The most significant disadvantages exist if the pallets are formed of wood, since such pallets tend to splinter or break relatively easily. This action may not only result in damage to the pallet to the extent at which it is no longer functional, but also could subject personnel who may come in contact with the pallet to injury from splinters. The pallet protector assembly of this invention, while suitable for use on any type of pallets is particularly suitable for use with prior art wooden pallets to minimize, if not prevent, damage to pallets themselves and to prevent splinter-induced injuries to personnel by shielding them from the sides and ends of the pallets. As best seen in FIG. 2 the pallet protector assembly 20, for a 1 by 2 array of pallets 10 (i.e., 1 row of 2 columns of pallets) basically comprises six elongated, bar-like, guard members 22A, 22B, 22C, 22D, 22E and 22F. The guard member 22A and 22B are each of identical construction while the guard members 22C, 22D, 22E and 22F are each of identical construction. In fact, the only difference between the guard members 22A/22B and the guard members 22C/22D/22E/22F is that the former are approximately 52 inches long while the latter are 44 inches long to enable them to be used with conventional 48 inch by 40 inch wood pallets. All of the guard members are preferably hollow members having a top wall 24 (FIG. 4), a bottom wall 26, an inside wall 28, an outside wall 30, and end wall 32, and another end wall 34. The guard members can be formed of any suitable material, two particularly suitable ones being polyethylene and polyolefin cellulose composite, but other plastics or other non-plastic materials can be used as well so long as they are somewhat light in weight, durable, and impact resistant. Moreover, the guard members need not be hollow, although that feature enables them to be quite light in weight for ease in handling. If hollow guard members formed of a plastic material are desired, they can be fabricated by either rotomolding, blow molding or any other suitable process.

In the 1 by 2 array of FIG. 1, the two pallets are disposed side-by-side so that the side rail 10B of one pallet is disposed immediately adjacent the side rail 10A of the other pallet. The guard member 22A is arranged to be located beside the side rail 10A of one pallet while the guard member 22B is arranged to be located beside the side rail 10B of the other pallet. Thus, the spacing between the ends 32 and 34 of each of the side guard members 22A and 22B is dimensioned so that its length as measured along its longitudinal axis is slightly longer, e.g., 4 inches longer, than the length, e.g., 48 inches, of the pallet 10 (the length of its stringers). This 2 inch slight overhang at each end of each of the side guard members enables each side guard member to be releasably secured to an associated one of the end guard members 22C–22F.

As can be seen, the guard members 22C and 22D are connected to each other and located along one end of the two pallets. The other side guard members 22E and 22F are similarly constructed, connected and disposed on the other end of the pallets. The length of each of the end guard members 22C and 22D is dimensioned so that each is also slightly longer, e.g., 4 inches longer, than the width, 40 inches, of each of the pallets 10 (the distance between the stringers). As will be described later, the two inch overhang beyond the end of the stringer 10A at the end 34 of the side guard member 22A enables it to mate with the end 32 of the end guard member 22C (which also overhangs the side of that stringer). In a similar manner the end 32 of the side guard member 22A mates with the end 34 of the end guard member 22E. So, too, the end 34 of the end guard member 22D mates with the end 32 of the side guard member 22B, while the end 34 of the side guard member 22B mates with the end 32 of the end guard member 22F. The end 34 of the end guard member 22C mates with the end 32 of the end guard member 22D, while the end 32 of the end guard member 22E mates with the end 34 of the end guard member 22F. The details of all of the mating connections between the various guard members just mentioned will be discussed later.

With the guard members 22A–22F so connected, they form a frame which encircles, but is ever so slightly spaced from the periphery of the pallet. The thickness, i.e., the distance between the surface of the inner wall 28 and the outer wall 30 of all of the guard members 22A, 22B, 22C and 22D, in the exemplary commercial embodiment is 2 inches. The height, i.e., the distance between the outer surface of the top wall 24 and the outer surface of the bottom wall 26, of all of the guard members 22A–22F, in the exemplary commercial embodiment is 4 inches, so that each guard member's height is at least equal to the thickness of a conventional 4 inch thick wood pallet. It should be pointed out that such a construction is merely exemplary. Thus, in some cases it may be desirable to utilize guard members of a greater height than the height of the pallets, in some cases it may be desirable to utilize guard members of the same height as the pallets, and in other cases it may be desirable to utilize guard members of a lower height than the pallets.

As mentioned earlier each of the guard members is arranged to be releasably secured to an associated guard member so that all of the guard members can be connected together to form a hollow rectangular frame for encircling the periphery of the pallet array, e.g., the two side-by-side pallets 10 of FIGS. 1 and 2. To that end, each of the guard members includes a respective female connector element 36 located in the end 32. In particular, in the embodiment shown the connector element constitutes a cylindrical hole or bore 36 located on a ledge 38 adjacent the end wall 32 of each guard member. The end 34 of each guard member includes a male connector element 40, in the form of a mating cylindrical pin 42 projecting outward from a ledge 42 adjacent the end wall 34. Each of the male connector elements or pins 40 is of substantially the same outside diameter as the inside diameter of each of the female connector element or hole 36 to enable any pin 40 to be matingly received therein to connect the two guard members composed of those mating connector members to be releasably secured to each other.

Thus, as best seen in FIG. 2, the pin 40 of the side guard member 22A is arranged to be releasably received within the hole 36 of the guard member 22C to secure the guard member 22A to the guard member 22C. The pin 40 of the end guard member 22C is arranged to be releasably received within the hole 36 of the end guard member 22D to secure the guard member 22C to the guard member 22D. The pin 40 of the end guard member 22D is arranged to be releasably received within the hole 36 in the side guard member 22B to secure the guard member 22D to the guard member 22B. The pin 40 of the side guard member 22B is arranged to be releasably received within the hole 36 in the end guard member 22F to secure the side guard member 22B to the end guard member 22F. The pin 40 of the end guard member 22F is arranged to be releasably received within the hole 36 in the end guard member 22E to secure the end guard member 22F to the end guard member 22E. Finally, the pin 40 ofthe end guard member 22E is arranged to be releasably received within the hole 36 in the side guard member 22A to secure the end guard member 22E to the side guard member 22A and thereby complete the frame encircling the two pallets 10. In particular, when the guard members are connected as just described they form a rectangular, self supporting frame assembly.

Moreover, as discussed above the guard members are dimensioned such that the spacing between the interior walls 28 of the side guard members 22A and 22B is ever so slightly greater than the combined width of the two side-by-side pallets, whereupon those interior walls 28 are spaced ever so slightly from the stringer 10A of one pallet and stringer 10B of the other pallet. In a similar manner, the spacing between the interior walls 28 of the joined end guard members 22C and 22D and the interior walls 28 of the joined end guard members 22E and 22F is ever so slightly greater to the length of the pallets so that those interior walls 28 are spaced ever so slightly from the pallet's ends. Thus, when the guard members are connected as just described they completely encircle and cover the ends and sides of the array of pallets, thereby protecting the pallets from impact-induced damage. If the pallets are formed of wood or some other material which may tend to splinter, the assembled protector assembly will prevent any person from coming in contact with the sides or ends of the pallets, thereby protecting the person from being injured by a splinter from the pallets.

In order to provide access to either end of the two side-by-side pallets to expose either pallet's tine receiving open-ended passages 18 so that the tines of the fork of a fork-lift truck or a palletjack may be inserted therein to lift or otherwise move the pallet, either or both of the end guard members 22B and 22C can be readily removed to expose their associated ends of the array of pallets or either or both of the end guard members 22E and 22F can be readily removed to expose their associated ends of the array of pallets, leaving the remaining guards assembled, if desired.

Since the guard members are formed as hollow plastic members they will exhibit some longitudinal flexibility. Therefore, one can expose the lower end of the left most pallet 10 shown in FIG. 2 by lifting upward on the end 34 of guard member 22E to flex it and thus remove its pin from opening 36 in guard member 22A. Then, the end 34 of guard member 22F may be lifted upwards to flex it to remove its pin from the opening 36 in guard member 22E. Once this is done the guard member 22E may be removed leaving the lower end of the pallet 10 exposed. That pallet can then be lifted by the tines of a fork lift.

As should be appreciated by those skilled in the art, since the pins 40 and mating holes 36 can only be disassembled along their longitudinal axis (an axis perpendicular to the plane of the pallets and perpendicular to the longitudinal axis of the guard members of which they are a part), accidental disconnection of any guard member from the assembled pallet protector array is prevented or at least deterred.

While the foregoing example has considered the removal of only one of the guard members, namely, end guard 22E, it is clear that any of the guard members can be readily removed to provide entry or access to any side or any end of any of the pallets in the array. If side access of either of the pallets 10 in the array of FIG. 1 is desired, each pallet may include a pair of slots (not shown) in its outside stringers 10A and 10B for accepting the tines of a fork-lift or pallet jack.

It should be pointed out at this juncture that the pallet protector assembly of this invention can be constructed so that each of its guard members includes a male connector element at one end and a female connector element at the other, each of which is of the same construction as disclosed herein or other types of mating shapes, for releasable connection to a mating connector element of another guard member. Moreover, the guard members may all be of the same dimensions for use with square pallets as opposed to the rectangular pallets 10 described heretofore. Thus, it should be clear that the size and shape of the guard members making up the pallet protector assembly of this invention is a matter of choice. Moreover, the pallet protector assembly or any portion of it can be colored or provided with suitable indicia to serve as some identification means, e.g., the guards can be colored to identify a particular department for which the pallet is to be used or to identify the material stored on the pallet.

Figure 5:
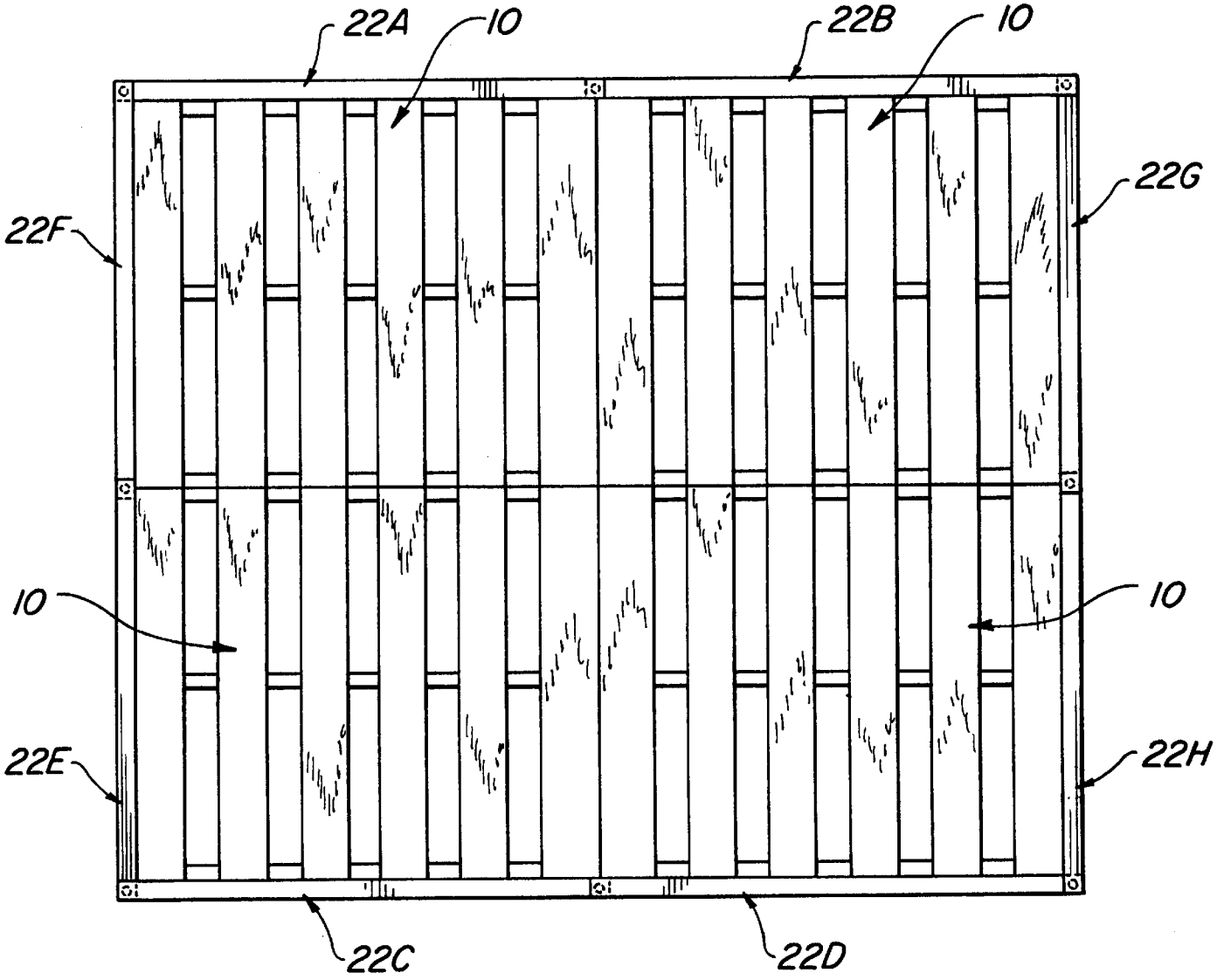
FIG. 5 is a top plan view of a pallet protector assembly constructed in accordance with the subject invention being shown in place about the periphery of a 2-by-2 array of four conventional pallets to form an "corral display"
Figure 6:
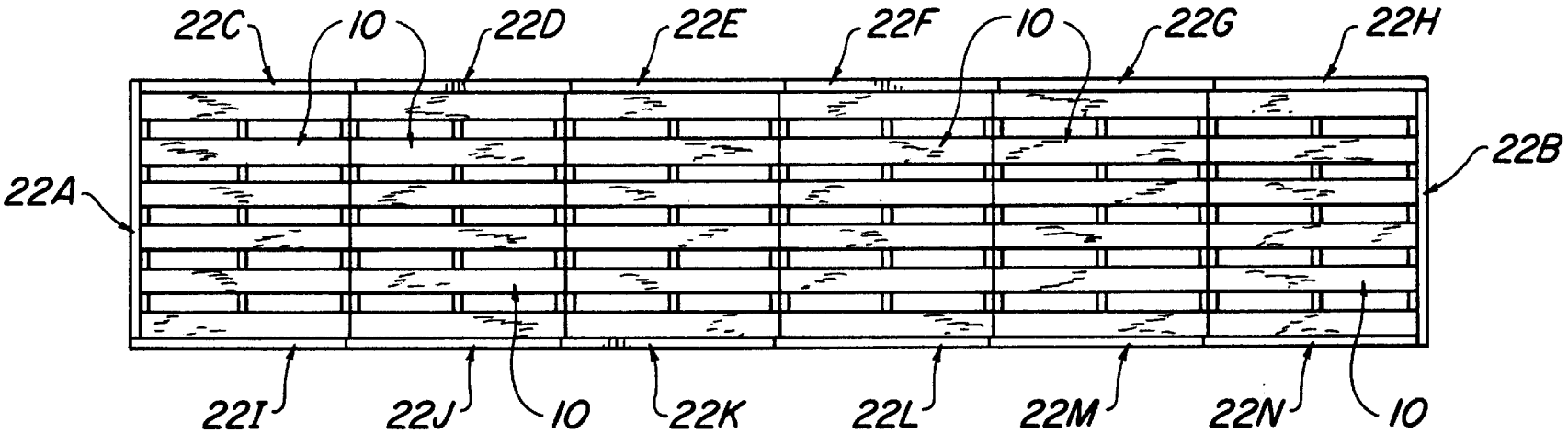
FIG. 6 is a top plan view of a pallet protector assembly constructed in accordance with the subject invention being shown in place about the periphery of a 1-by-6 array of six conventional pallets to form a "power aisle" display.

It should be noted at this juncture that the pallet protector assembly can be configured to extend about the periphery of any number of pallets in an A row by B column array, where A and B are at least 1. Thus, for example, four pallets can be arranged in an array of two rows by two columns to form a "corral" type display like shown in FIG. 5. That array consists of eight guard members, namely, side guard members 22A, 22B, 22C and 22D and end guard members 22E, 22F, 22G and 22H. The side guard members 22A–22D of FIG. 5 are constructed like the side guard members 22A and 22B of FIG. 1, whereas the end guard members 22E–22H of the protector assembly of FIG. 5 are the same as the end guard members 22C–22F of FIG. 1. In FIG. 6 six pallets are arranged in a 1 row by 6 column array which may be called a "Continuous Power Aisle" display. In that arrangement, the assembly consists of fourteen guard members, with side guard members 22A and 22B being constructed like the side guard members 22A and 22B of the assembly of FIG. 1, while the end guard members 22C, 22D, 22E, 22F, 22G, 22H, 221, 22J, 22K, 22L, 22M and 22N are constructed like the end guard members 22C–22F of the assembly of FIG. 1. As should be appreciated by those skilled in the art, these arrangements are merely exemplary and should not be deemed to limit the applicability of this invention.

As should also be appreciated from the foregoing the pallet protector of this invention is simple in construction, can be manufactured at low cost, can be readily assembled and disassembled without the need for any special tools, is light weight and readily transportable, and should exhibit a long life. By establishing a surrounding frame for plural pallets of an array of any A rows by B column of pallets, the pallet protector assembly of this invention serves to hold those pallets together, while protecting employees and customers from injuries related to exposed wood splinters from those pallets and also preventing or minimizing damage to the pallets themselves. Moreover, the clean lines of the assembled pallet protector should serve to dress up unsightly conventional wood pallets.

Without further elaboration the foregoing will so fully illustrate my invention that others may, by applying current or future knowledge, adopt the same for use under various conditions of service.

I claim:

1. A pallet protector assembly adapted for use with at least two conventional pallets arranged in an array closely adjacent each other, each of the pallets having a plurality of stringers disposed generally parallel to one another underneath an upper deck, the deck being formed of plural spaced-apart deck-boards, each of the pallets also having a pair of sides and a pair of ends, said pallet protector assembly comprising at least six elongated bar-like guard members, each of said guard members having a first end portion and a second end portion, said first end portion including a first connector, said second end portion comprising a second connector, said first connector of any one of said guard members being arranged to be releasably secured to said second connector of any other of said guard members, all of said guard members being arranged to be secured to each other together to form a self-supporting framefor encircling the perihery of the array of paalets, with said guard members being resistant to accidental disconnection from each other, said frame being adapted to encircle the periphery of the array of pallets.

2. The pallet protector assembly of claim 1 wherein each of said guard members is formed of a light-weight, impact resistant material.

3. The pallet protector assembly of claim 2 wherein said material comprises a plastic.

4. The pallet protector assembly of claim 3 wherein said plastic is selected from the group consisting of polyethylene and polyolefin cellulose composite.

5. The pallet protector assembly of claim 1 wherein each of said guard members is hollow.

6. The pallet protector assembly of claim 1 wherein each of said guard members includes a top surface and a bottom surface, and wherein first end portion includes a notch therein and said second end portion includes a notch therein, said notch of said first end portion of any of said guard members being arranged to mate with said notch of said second end portion of any other of said guard members.

7. The pallet protector assembly of claim 6 wherein said first connector comprises a male member, wherein said second connector comprises a female member, wherein said male member is located at one of said notches and said female member is located at the other of said notches.

8. The pallet protector assembly of claim 7 wherein each of said guard members has a longitudinal axis and a transverse axis, said longitudinal axis extending in a plane generally parallel to the plane of the top deck-boards of the pallets, said transverse axis extending generally perpendicularly to the plane of the top deck-boards of the pallets, and wherein said male and female members which are connected together are resistant to accidental disconnection along said longitudinal axis, but are readily disconnectable along said transverse axis.

9. The pallet protector assembly of claim 1 wherein said first connector comprises a male member and wherein said second connector comprises a female member.

10. The pallet protector assembly of claim 1 wherein the array comprises A rows and B columns, where A is at least one, and B is at least two, and wherein said pallet protector assembly comprises N guard members, where N=2(A+B).

11. The pallet protector assembly of claim 10 wherein A and B are each at least two.

12. In combination an array of plural pallets and a protector assembly therefor, each of said pallets having a plurality of stringers disposed generally parallel to one another underneath an upper deck, each of said pallets also having a pair of sides and a pair of ends, said pallet protector assembly comprising at least six elongated bar-like guard members, each of said guard members having a first end portion and a second end portion, said first end portion including a first connector, said second end portion comprising a second connector, said first connector of any one of said guard members being arranged to be releasably secured to said second connector of any other of said guard members, all of said guard members being arranged to be secured to each other to form a self-supporting frame for encircling the periphery of the array of pallets, with said guard members being resistant to accidental disconnection from each other.

13. The combination of claim 12 wherein each of said guard members is formed of a light-weight, impact resistant material.

14. The combination of claim 13 wherein said material comprises a plastic.

15. The combination of claim 14 wherein said plastic is selected from the group consisting of polyethylene and polyolefin cellulose composite.

16. The combination of claim 12 wherein each of said guard members is hollow.

17. The combination of claim 12 wherein each of said guard members includes a top surface and a bottom surface, and wherein first end portion includes a notch therein and said second end portion includes a notch therein, said notch of said first end portion of any of said guard members being arranged to mate with said notch of said second end portion of any other of said guard members.

18. The combination of claim 17 wherein said first connector comprises a male member, wherein said second connector comprises a female member, wherein said male member is located at one of said notches and said female member is located at the other of said notches.

19. The combination of claim 18 wherein each of said guard members has a longitudinal axis and a transverse axis, said longitudinal axis extending in a plane generally parallel to the plane of the top deck-boards of the pallets, said transverse axis extending generally perpendicularly to the plane of the top deck-boards of the pallets, and wherein said male and female members which are connected together are resistant to accidental disconnection along said longitudinal axis, but are readily disconnectable along said transverse axis.

20. The combination of claim 12 wherein said first connector comprises a male member and wherein said second connector comprises a female member.

21. The combination of claim 12 wherein the array comprises A rows and B columns, where A is at least one, and B is at least two, and wherein said pallet protector assembly comprises N guard members, where N=2(A+B).

22. The combination of claim 21 wherein A and B are each at least two.

* * * * *